United States Patent [19]

Kopolow

[11] Patent Number: 4,552,618

[45] Date of Patent: Nov. 12, 1985

[54] STABILIZED ABSORBENT BOARDS

[75] Inventor: Stephen L. Kopolow, Plainsboro, N.J.

[73] Assignee: Personal Products Company, Milltown, N.J.

[21] Appl. No.: 599,102

[22] Filed: Apr. 11, 1984

Related U.S. Application Data

[63] Continuation-in-part of Ser. No. 289,609, Aug. 3, 1981, abandoned.

[51] Int. Cl.[4] ..... D21H 5/12

[52] U.S. Cl. ..... 162/157.1; 162/146; 162/157.6; 162/207; 162/224; 162/225

[58] Field of Search ..... 162/146, 157.2, 157.6, 162/207, 224, 225, 157.1

[56] References Cited

U.S. PATENT DOCUMENTS

| | | | |
|---|---|---|---|
| 3,194,727 | 7/1965 | Adams et al. | 162/157 C |
| 3,232,823 | 2/1966 | Sobolev | 162/157 C |
| 3,731,686 | 5/1973 | Chatterjee | 128/285 |
| 3,889,678 | 6/1975 | Chatterjee et al. | 128/284 |

*Primary Examiner*—Peter Chin

*Attorney, Agent, or Firm*—Jason Lipow

[57] ABSTRACT

An absorbent material comprising hydrocolloidal fibers provided in board form having substantial structural integrity both in the dry state and after being wetted with body fluids. The board comprising hydrocolloidal fibers is subjected to a heat treatment step whereby the board is heated, in a dry state to impart such stability.

7 Claims, 5 Drawing Figures

STABILIZED ABSORBENT BOARDS

This application is a continuation-in-part of my copending application, Ser. No. 289,609 filed on August 3, 1981 now abandoned.

BACKGROUND OF THE INVENTION

This invention concerns methods and products utilizing fibrous absorbent bodies for absorbing fluids. In particular, the invention concerns products such as catamenial tampons, diapers, sanitary napkins and the like and is specifically directed toward fibrous absorbent bodies which are easily handled in processes for manufacturing such products and which maintain their integrity when wet with body fluids.

The vast majority of body fluid absorbent products now in use comprise, at least in their formative stages, pads of loosely associated fibrous, and generally cellulosic, absorbent materials such as comminuted wood pulp fluff, rayon staple, cotton, cotton linters and the like. For generations, these materials have proven to be useful and effective in dressings, diapers and sanitary protection devices in that such materials are absorbent, inexpensive, and, in the case of absorbent products which must be worn by the user for substantial periods of time, such materials are flexible and comfortable. Unfortunately, balanced against these highly desirable properties, is the fact that pads manufactured from the loosely associated fibrous materials are relatively weak, having little tensile strength and must be handled gingerly throughout any manufacturing process.

The manufacturing problems associated with these loosely associated fibrous materials has been aggravated to some extent by the desire to incorporate into the body of such fibrous materials certain cellulosic materials (herein termed hydrocolloid) which exhibit substantially increased absorptive properties by virtue of chemical modification. Examples of such materials are the grafted cellulosic copolymers described in U.S. Pat. No. 3,889,678 issued to Pronoy Chatterjee, et al. on June 17, 1975; and the cross-linked carboxyalkyl cellulosic materials described in U.S. Pat. Nos. 3,731,686 and 3,858,585 issued to Pronoy Chatterjee on May 8, 1973 and June 7, 1975; and in U.S. Pat. No. 3,589,364 issued to W. L. Dean, et al. on June 29, 1971. These hydrocolloidal materials are in the form of highly swellable and highly retentive fibers. It is desirable to combine these fibers with the more conventional absorbent materials such as rayon, woodpulp, cotton or the like to produce an absorbent body having increased fluid retentive properties. Unfortunately, when mixing such fibrous materials, it is not an easy processing task to get an even distribution and this adds to the burden of producing an absorbent body for the products of interest herein.

In my copending U.S. patent application Ser. No. 82,400, filed Oct. 5, 1979, I describe a method for avoiding the difficulty of handling such materials and specifically describe a method whereby the materials are formed into a board and the board is rendered flexible by virtue of being dry compressed after its formation. While this method has indeed allowed the use of fibrous systems in a more readily processible form and produces products which are comfortable to the user, there are still drawbacks associated with this product. Specifically it has been found that when boards of fibrous systems incorporating such chemically modified fibers as those described above become wet with body fluids such as urine or menstrual fluid, the boards deform greatly, particularly under the influence of pressures common in the use of products such as tampons, diapers and the like. Under the influence of pressures exerted by the wearer in normal use of such products, the boards tend to collapse, flow and deform thereby greatly reducing their abilities to trap fluids in the interstices between the fibers and allow the penetration of additional fluid. Said in other words, the deformation tends to block the ability of fluid to penetrate and hence fully utilize the absorbent capacities of these absorbent, board-like materials.

Accordingly, there is a need for producing a densified board-like absorbent material which can be readily handled during processing, which is comfortable when incorporated in absorbent products worn by the user, and which will resist deformation when subjected to pressure in the wet state.

SUMMARY OF THE INVENTION

In accordance with the teachings of this invention it has now been discovered that absorbent material comprising hydrocolloidal fibers may now be provided in board form having substantial structural integrity both in the dry state and after being wetted with body fluids. Specifically, it has been discovered that a board of hydrocolloidal fibers may be prepared which will exhibit a substantial resistance to deformation in the wet state and hence be capable of absorbing further body fluids without collapsing and blocking penetration of fluid therein.

In accordance with the teachings herein, a board comprising hydrocolloidal fibers is subjected to a heat treatment step whereby the board is heated, in the dry state, at a temperature ranging from about 150° C. to about 200° C., for a period of about 3 to 30 minutes and preferably 170°–180° C. for 10–15 minutes.

The board may be formed by such conventional means as wet forming wherein a wet web of hydrocolloidal fibers is formed from a slurry by such means as by depositing the slurry onto a screen and drawing water away with the aid of a vacuum. The wet web is then dried to form relatively hard inflexible board. As described in my above-mentioned copending patent application, the board may now be densified and rendered flexible by application of pressure. The resulting board is then subjected to the heat treatment being taught herein whereby the board is rendered resistant to deformation when wetted.

DETAILED DESCRIPTION OF THE INVENTION

Figure 1:
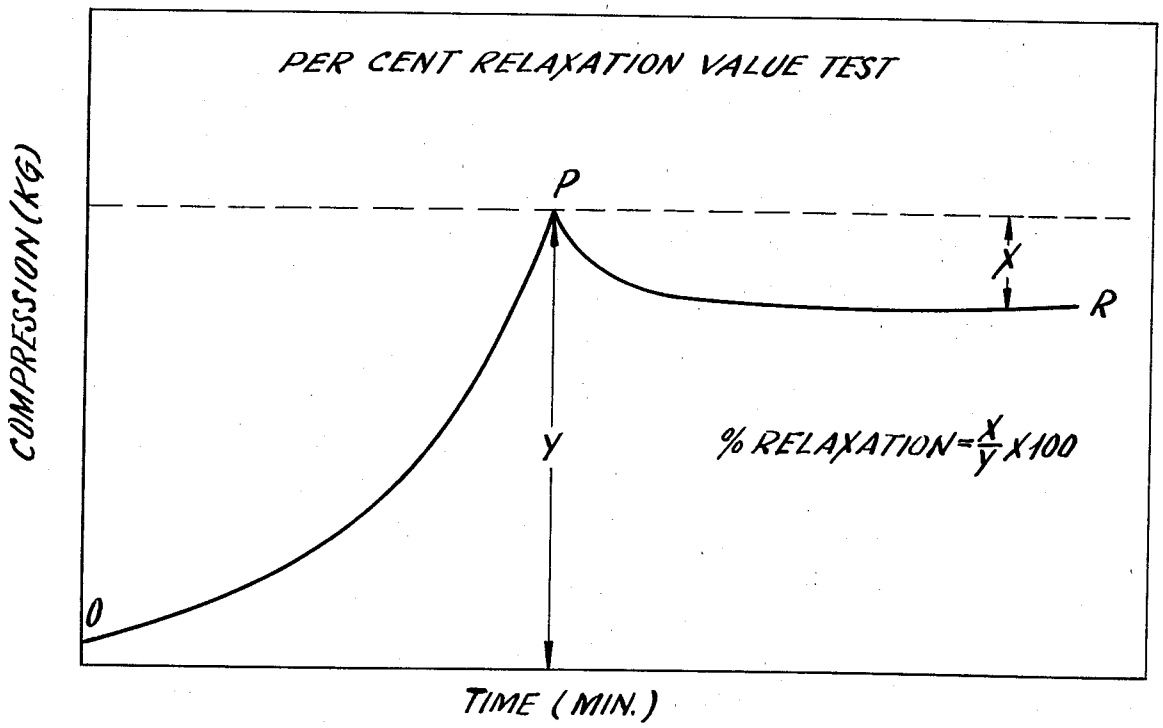
FIG. 1 is a graphical illustration of the time-load relationship when boards are subjected to pressure in the wet state.

The boards with which this invention is concerned comprise fibers herein characterized as hydrocolloidal. The base of these fibers may be such commonly used cellulosic materials as, for example, wood pulp, cotton, grasses or regenerated cellulose fibers and the like. It is generally preferred that these fibers lie in the range of about 100 to about 3,000 microns in length. Currently, because of both cost and availability considerations, wood pulp is the cellulosic fiber of choice. The base fibers are rendered hydrocolloidal by virtue of chemical modification whereby they become water swellable and capable of absorbing water in an amount which is at least about ten times their own weight, in the dry form, and preferably about fifteen to about thirty times their dry weight. The chemical modification consists of chemically bonding to the polymeric backbone of the base materials, hydrophilic groups or polymers containing hydrophilic groups. Included in this class of materials are base materials which are modified by being carboxyalkylated, phosphonoalkylated, sulfoalkylated or phosphorylated to render them highly hydrophilic. Such modified polymers may also be crosslinked to enhance their hydrophilicity and render them water insoluble.

These same base materials may also serve, for example, as the backbone onto which other polymer moieties may be bonded by grafted copolymerization techniques. Such grafted polysaccharides and the method of manufacture are described in U.S. Pat. No. 3,889,678 to Chatterjee, et al. and may be described as polysaccharide chains having grafted thereon a hydrophilic chain of the general formula:

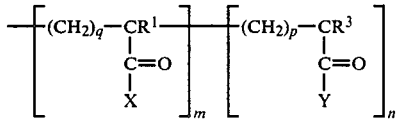

wherein $R^1$ and $R^2$ are selected from the group consisting of hydrogen and alkyl having 1 to 4 carbon atoms, X and Y are selected from the group consisting of —OH, —O(alkali metal), and —$NH_2$, wherein m is an integer having a value of 0 to about 5000, n is an integer having a value of 0 to about 5000, the total number of m and n moieties on a chain is at least 500, p is an integer having a value of zero or 1, and q is an integer having a value of 1 to 4. Preferably the hydrophilic chain is a hydrolyzed copolymer of acrylonitrile and methyl methacrylate or ethyl acrylate monomers as are set out in U.S. Pat. No. 3,889,678.

The grafted polysaccharides described above and, in particular, grafted cellulose as well as carboxy methylcellulose are the hydrocolloidal fibers of choice. The hydrocolloidal fibers may be combined with other cellulosic or non-cellulosic absorbent fibers in producing the board of this invention.

The fibers are combined with water in a slurry forming station to form a slurry which may be conveyed to a web forming station. Generally, the slurry should comprise of no more than about 0.1 and preferably no more than about 0.05% solids. The slurry may be formed in several ways known in the art associated with wet laying of fibrous webs. For instance it may be prudent to form the slurry at high solids concentration, e.g., about 1.5% by weight solids and then further dilute the slurry with the addition of more water to the desired concentration. Irrespective of how the slurry is formed, it is next passed to a web forming station where a wet web is formed, for example, by depositing the slurry onto a continuous belt and maintaining a differential pressure across the face of the belt to remove a preponderance of the water and leave a loosely compacted wet web of fibers. At this point in the process it is desirable that the web has a solids content of no more than about 30% by weight of wet web and not less than about 6. The wet web is next passed to a drying station wherein the web is dried to a water content of less than about 10% by weight and preferably less than about 5%.

In accordance with this invention the web, now dried to what is essentially ambient conditions, is heat treated by being subjected to a heating step at a temperature of about 150° C. to about 200° C. for a time period of about 3 to 30 about minutes. It should be understood that at the higher temperature range the period may be nearer the lower limits of the time range and vice versa. The heat treatment of the sheet can be accomplished by passing the sheet through an air circulated tunnel dryer operated at the appropriate temperature and belt speed.

The resulting product is a board that is highly resistant to deformation under pressure when wet. This property may be quantified by use of a test to determine the Percent Relaxation Value, as defined hereinafter. In accordance with this test, a sample board of a given size is wet out completely and any excess water is removed by blotting the sample between paper towels. The wet board is then placed on a compression cell in an Instron Tester. The head of the Instron Tester is lowered until it nearly touches the wet board and the recorder is started. The Instron head is then slowly lowered until a maximum compression load of a given arbitrary weight (e.g. 25 kilograms) is indicated on the chart of the recorder. When a 25 kilogram maximum compression load is reached, the Instron is stopped and the sample is allowed to equilibrate under the load.

As the sample is allowed to equilibrate, the compression load decreases as the sample deforms under the forces exerted by the Instron tester head. The deformation begins rapidly and then slowly decreases until a constant load, in a deformed state, prevails. The Percent Relaxation Value is defined as the difference between the 25 kilogram load and the load at equilibrium divided by the 25 kilogram load and multiplied by 100.

FIG. 1 illustrates the relationship graphically and represents a plot of the compression load versus time. The force of the Instron head is gradually increased to the value of P over a period of time and P may be selected arbitrarily e.g., 25 kilograms. After the board is allowed to equilibrate, it reaches a constant compression load of the value R. Percent relaxation value is then defined as $((P-R)/P)\times 100$. It will be understood that the lower the value for percent relaxation, the higher the stability of the board under wet conditions and, conversely, the higher the percent relaxation value, the the lower the wet stability and the more likely the board will be to deform under pressure when wet.

EXAMPLE 1

A series of sample boards are prepared from hydrocolloidal fibrous material made in accordance with example III of the aforementioned U.S. Pat. No. 3,889,678. This material is a cellulose graft copolymer consisting of a cellulose backbone having grafted thereto hydrolyzed polymer moieties of poly(acrylonitrile) and poly(ethyl acrylate) by combining wood pulp, acrylonitrile and ethyl acrylate as the starting materials in the following weight properties, 1 part wood pulp to 1.40 parts ethyl acrylate to 0.8 parts acrylonitrile. This hydrocolloidal material is in fibrous form, the fibers having an average fiber length of approximately 0.89 millimeters. In accordance with aforementioned U.S. Pat. No. 3,889,678, the grafted material is subjected to a hydrolysis step. Table 2 sets out the conditions under which these specific samples are hydrolyzed to produce hydrolyzed product having variable degrees of hydrolysis and, hence, being variably hydrophilic.

TABLE 1

| SAMPLE | HYDROLYSIS Time (HRS) | Temperature (°C.) |
|---|---|---|
| A | 1.75 | 80 |
| B | 2.75 | 80 |
| C | 3.75 | 80 |

The hydrocolloidal fibrous material is formed into a board by first dispersing the fibers in water to yield a slurry having a consistency of 1.17% by weight solids. One liter of the slurry is placed in a handsheet mold measuring 7.5 inches by 7.5 inches and manufactured by Williams Apparatus Company of Watertown, New York. The slurry is then diluted to a consistency of 0.01% by weight solids in accordance with the procedure set out in TAPPI Standard Method T-2050S71.

After mixing thoroughly, the water is allowed to gravity drain, leaving a wet hydrocolloid fibrous web having a solids content of about 5% based on the weight of the dry web. The wet web is then blotted with blotter boards, squeezed to remove excess water, and then dried in an air circulated oven to a water content of about 2% water, by weight of dry material.

The resulting boards have a basis weight of 320 lbs. per 3000 sq. feet.

In accordance with the teachings of this invention, the various board samples are subjected to a heat treatment step wherein the boards are heated at 175° C. for various periods of time. The sample boards are then tested to determine their Percent Relaxation Value as described in accordance with the compression test set out above.

Figure 2:
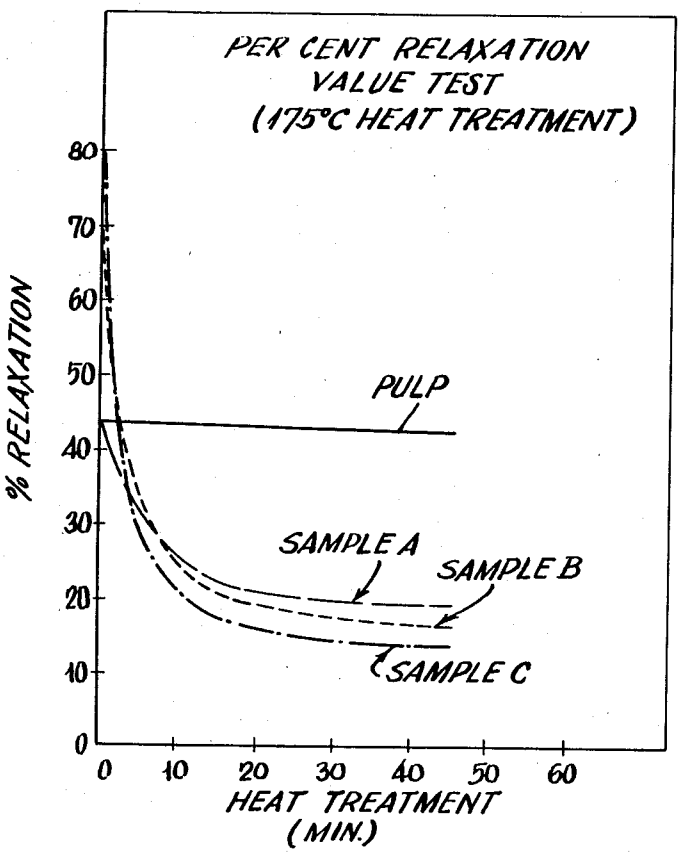
FIG. 2 is a graphical illustration of the relationship between percent relaxation value and heat treatment time in accordance with the teachings of this invention.

FIG. 2 illustrates the results of this test with respect to samples A, B and C of Table 1, which samples have been subjected to heat treatments of from zero to 60 minutes at 175° C. As can be noted from FIG. 2, at zero minutes of heat treatment i.e., no heat treatment, the Percent Relaxation Value is basically a function of the degree of hydrolysis or said in other words, the hydrophilicity of the hydrocolloidal material. Sample C, having a high degree of hydrophilicity, has a Percent Relaxation Value of 81; that is to say, a low wet stability. Sample A, having a low degree of hydrophilicity, has a Percent Relaxation Value of 44 indicating a relatively high wet stability. Sample B, having medium degree of hydrophilicity exhibits a Percent Relaxation Value of 71, an intermediate wet stability. As these samples are subjected to heat treatment for periods of time from zero to 50 minutes, it will be noted that the Percent Relaxation Value drops dramatically and tends to stabilize for these samples at values ranging from 15 to 25 percent after a heat treatment of from 10 to 20 minutes. Thereafter, the Percent Relaxation Value seems to stabilize and no longer decreases with increasing heat treatment time. As a control, a sample of wood pulp is also subjected to the same board-forming process and subsequent heat treatment. As shown in FIG. 2, the sample wood pulp has approximately the same Percent Relaxation Value at zero minutes of heat treatment (untreated) as does sample A, i.e., the sample having the lowest degree of hydrophilicity. However in marked contrast to the hydrocolloidal board of this invention, wood pulp shows essentially no decrease in Percent Relaxation Value with increasing heat treatment time and instead remains substantially less wet stable than the hydrocolloidal boards of this invention.

EXAMPLE II

Figure 3:
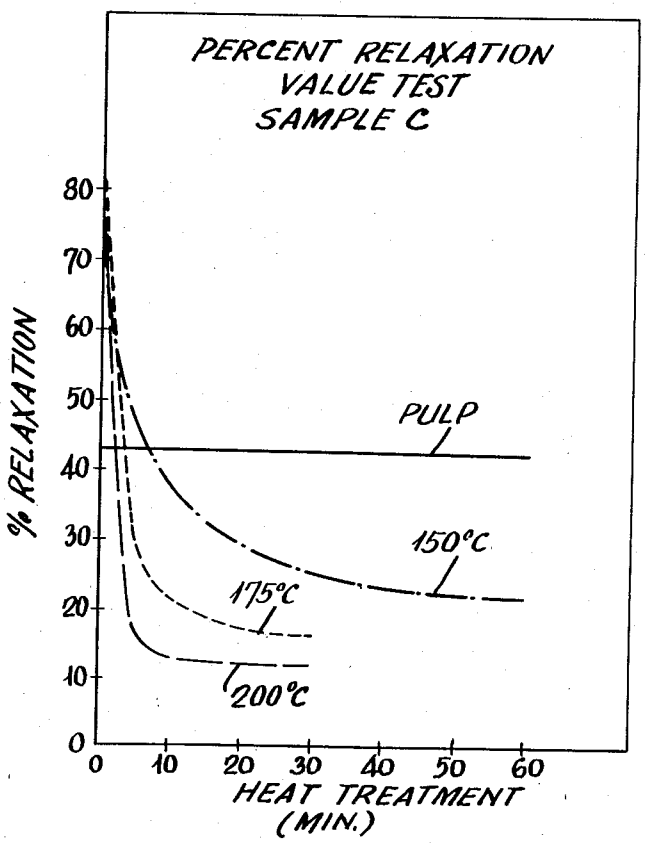
FIG. 3 is a graphical illustration of the same relationship depicted in FIG. 2, further illustrating the effect of varying temperatures of heat treatment.

To illustrate the time-temperature relationship of the materials treated in accordance with the teachings of this invention, sample C of Example I above is subjected to temperatures of 150°, 175°, and 200° C. The results of the Percent Relaxation Value test for these materials is illustrated in FIG. 3. As can be seen from this figure, it requires 60 minutes to reach a Percent Relaxation Value of 20 when the heat treatment occurred at 150° C. At a heat treatment of 175° C. it requires 10–15 minutes, and at a heat treatment temperature of 200° C. it requires only 5 minutes to reach this Percent Relaxation Value. As a control, the pulp sample heated at a heat treatment temperature of 175° C. is also illustrated in FIG. 3 and essentially does not vary in Percent Relaxation Value with the time of heat treatment.

EXAMPLE III

Figure 4:
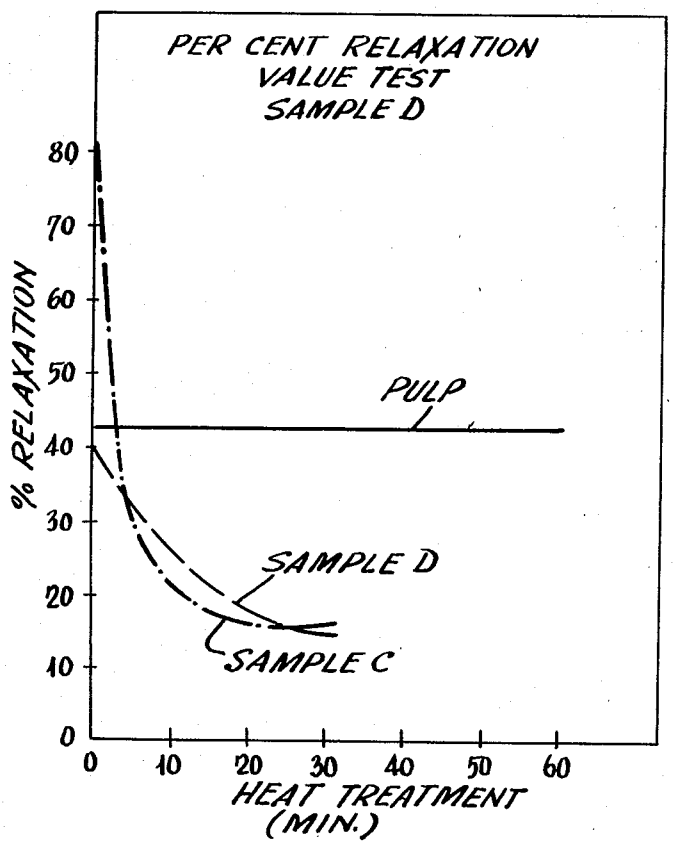
FIG. 4 is a graphical illustration of the same relationship depicted in FIG. 2 utilizing a different hydrocolloidal material.

A sample D of hydrocolloidal material of the type described with respect to Example I, is heat treated at a temperature of 175° C. for varying time periods. This sample D is made in accordance with the process of Example I with the exception that the starting materials used are in the weight ratio of 1 part cellulose to 2.75 parts ethyl acrylate to 1.6 parts acrylonitrile. The sample is hydrolyzed at 80° C. for two hours. FIG. 4 illustrates graphically the change in Percent Relaxation Value with varying time of heat treatment at 175° C. As can be seen from this figure, the sample boards are stabilized in about 10–15 minutes to a Percent Relaxation Value of approximately 20. Superimposed on FIG. 4 are the results of Example I which more or less perform equivalently to the sample of this Example with respect to Percent Relaxation Value. Also superimposed is wood pulp as a control.

EXAMPLE IV

Figure 5:
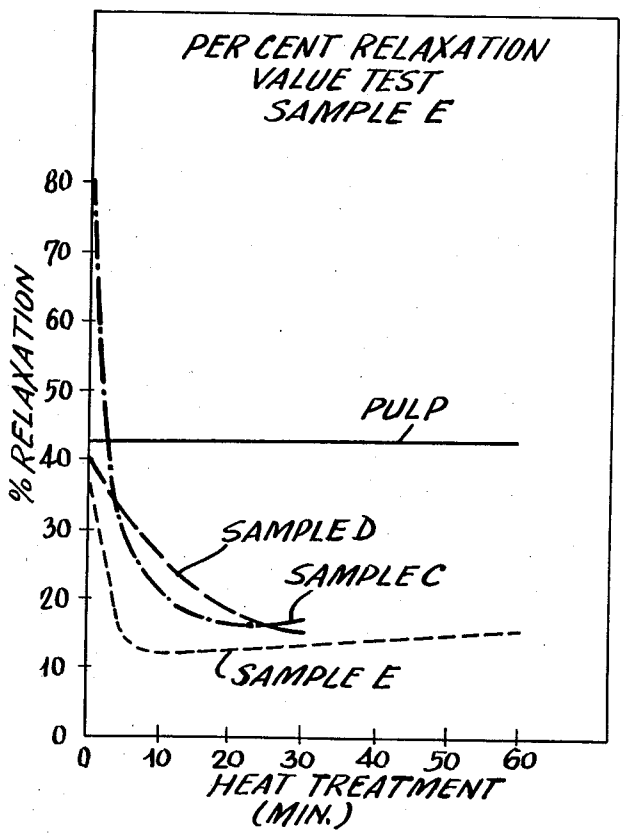
FIG. 5 is the same graphical representation utilizing still another hydrocolloidal material.

Absorbent fiberous board is provided using the method described in Example I with the exception that the fibrous mix consists of 50% wood pulp fibers and 50% by weight of a carboxymethylated cellulose fiber that has been crosslinked and is sold by the Hercules Company of Wilmington, Del., under the trademark "Aqualon". The board produced by the method of Example I is tested for percent relaxation value after being heated at 175° C. for various time intervals. The results are shown in FIG. 5 and as can be seen from this Figure, the heat treated carboxymethyl cellulose containing board, Sample E reach a constant Percent Relaxation Value; i.e., stability, in about 4 minutes of heat treatment at 175° C. This is substantially faster than the grafted cellulose copolymers of the prior examples.

EXAMPLE V

To illustrate the importance of the heat treatment of this invention being performed on a dried board which is the product of a wet laying process the following example is given. A series of sheets comprising the carboxy methylated cellulose fibers sold by the Hercules Company of Wilmington, Del. under the tradename of Aqualon are blended in the dry state with wood pulp in a 50/50 weight ratio. The sheets are made by a dry forming process wherein the loose fiber blend is compressed in a dye to a sheet having a basis weight of 320 pounds per 3,000 square feet and a density of 0.2 grams per cubic centimeter. A second series of sheets is made from the same fibrous blend but is first slurried in water as described in Example I and formed by a wet laying process into a board. Both series of sheets are subjected to varying degrees of heat treatment and the percent relaxation value is determined. The results are set out in Table 2 below. As can be noted from this Table, the effect of heat treatment on reducing the percent relaxation value and hence preparing a more stabilized sheet is minimal. The control sample had a value of 30 whereas heat treatment reduced the relaxation value to no lower than 21. In contrast therewith, the wet laid sheets showed a marked reduction in percent relaxation value with heat treatment. The original wet laid sheet with no heat treatment had a percent value of 38 which was reduced to as low as 12 by virtue of the heat treatment step of this invention.

TABLE 2

| Sample | Sheet Preparation | |
|---|---|---|
| | Dry Laid | Wet Laid |
| No heat | 30 | 38 |
| 5 min., 175° C. | 23 | 14 |
| 10 min., 175° C. | 21 | 12 |
| 30 min., 175° C. | 25 | 15 |

What is claimed is:

1. A method for providing a board including hydrocolloidal fibers, said board having increased resistance to deformation in the wet state while still maintaining the capacity to absorb body fluids comprising the steps: forming said board comprising said hydrocolloidal fibers from an aqueous slurry comprising said hydrocolloidal fibers; heating said board at a temperature ranging from about 150° C. to about 250° C. for a period of about 3 to about 30 minutes.

2. The method of claim 1 wherein said board is heated at a temperature of about 170° C. to about 180° C. for about 10 to about 15 minutes.

3. The method of claim 1 wherein said hydrocolloidal fibers are selected from the group consisting of carboxyalkylated, phosphoralkylated, sulfoalkylated, phosphorylated or grafted cellulose fibers.

4. The method of claim 3 wherein said carboxyalkylated cellulose fibers are water insoluble carboxymethyl cellulose.

5. The method of claim 3 wherein said grafted cellulose fibers comprise cellulose having grafted thereon hydrophobic polymer moieties of the formula:

$$-\left[(CH_2)_q-\underset{\substack{C=O\\X}}{CR^1}\right]_m\left[(CH_2)_p-\underset{\substack{C=O\\Y}}{CR^2}\right]_n$$

wherein R and R are selected from the group consisting of hydrogen and alkyl having 1 to 4 carbon atoms, X and Y are selected from the group consisting of —OH, —O(alkali metal), and —NH, wherein m is an integer having a value of 0 to about 5000, n is an integer having a value of 0 to about 5000, the total number of m and n moieties on a chain is at least 500, p is an integer having a value of zero to 1, and q is an integer having a value of 1 to 4.

6. The method of claim 5 wherein said polymer moieties are partially hydrolyzed copolymers of acrylonitrile and ethyl acrylate monomers.

7. The method of claim 5 wherein said polymer moieties are partially hydrolyzed copolymers of acrylonitrile and methyl methacrylate.

* * * * *